United States Patent [19]

Krob et al.

[11] 4,116,461

[45] Sep. 26, 1978

[54] BRAKE DEVICE FOR SKIS

[75] Inventors: Erwin Krob, Vienna; Josef Svoboda, Schwechat, both of Austria

[73] Assignee: TMC Corporation, Baar,Zug, Switzerland

[21] Appl. No.: 744,939

[22] Filed: Nov. 24, 1976

[30] Foreign Application Priority Data

Dec. 5, 1975 [AT] Austria ..... 9252/75

[51] Int. Cl.[2] ..... A63C 7/10

[52] U.S. Cl. ..... 280/605

[58] Field of Search ..... 280/605, 604; 188/5

[56] References Cited

U.S. PATENT DOCUMENTS

| | | | |
|---|---|---|---|
| 3,877,709 | 4/1975 | Fritz | 280/605 |
| 3,909,024 | 9/1975 | Salomon | 280/605 |
| 3,964,760 | 6/1976 | Riedel | 280/605 |

FOREIGN PATENT DOCUMENTS

| | | | |
|---|---|---|---|
| 2,228,506 | 12/1974 | France | 280/605 |
| 2,408,941 | 9/1975 | Fed. Rep. of Germany | 280/605 |

*Primary Examiner*—David M. Mitchell

*Attorney, Agent, or Firm*—Blanchard, Flynn, Thiel, Boutell & Tanis

[57] ABSTRACT

A brake device for skis wherein a pair of levers are pivotally mounted on a bracket mounted on the upper surface of the ski. Each of the levers is composed of two arms wherein one arm functions as a brake wing and the other arm functions as a control element. Projections are provided on the ski binding which cooperate with the lever arms functioning as the control elements to control the movement of the levers during a pivotal movement of the ski binding to the ready or cocked position. As a result, the ski brake is held in the cocked or ready position by the ski binding mechanism rather than directly by the ski boot.

11 Claims, 7 Drawing Figures

BRAKE DEVICE FOR SKIS

FIELD OF THE INVENTION

The invention relates to a brake device for skis in which in the binding area there is provided at least one lever or the like which can be swung by spring force under the bottom ski surface and which lever, when the boot is in the ski binding, is above the area of the running bottom surface and during release of the boot from the ski is moved by pivoting into a position which substantially perpendicular with respect to the ski surface and prevents a runaway of the ski wherein the lever has two arms of which one lever arm is a brake wing and the other lever arm is a control element functioning directly or indirectly through a ski binding part with the ski boot.

BACKGROUND OF THE INVENTION

A brake of the abovementioned type in which the lever arm which acts as a control element is associated with the ski boot is described for example in Austrian Pat. No. 216,398. In this device, the lever is positioned on a ski surface in front of the heel in a recess in the boot sole so that such a device can only be used for boots wherein the sole has such a recess. A further disadvantage lies in the lever, arm which serves as a brake wing, extending forwardly beside the ski surface, which can cause the skier to become snagged on obstacles.

A similar brake device is described also in U.S. Pat. No. 3,195,911 in which the lever will rest above the upwardly facing ski surface in the nonuse condition. Through this, the danger that the skier could become snagged on obstacles has been overcome. The lever is here positioned behind the ski binding so that the use of this brake device is not dependent on the design of the ski boot. Compared with this, a substantial disadvantage lies in the bracket having to be arranged transversely with respect to the longitudinal direction of the ski so that here the lever can only be mounted on one side. However, a one-sided braking action is no longer sufficient according to the latest knowledge and respective safety regulations for a brake device of this type.

The market also offers brake devices which are operated by a sole plate. Therefore, it is known to control a brake device of the abovementioned type not only directly by the ski boot but also indirectly through a ski binding part. However, these known devices are special constructions which can be operated only with certain ski binding parts. In the case of a brake device of this type, there exists an additional disadvantage, namely that after the braking action has occurred, namely when the lever has been swung into the braking position, the return to the cocked or ready position can be accomplished only manually.

The goal of the invention is to overcome the mentioned disadvantages in a brake device of the abovementioned type wherein the brake device is operated through a ski binding part, and to provide a brake device as aforesaid which can be universally associated with all ski bindings which, upon release of the boot, experience a longitudial movement on one of their parts.

The set purpose is attained inventively by providing a projection on the ski binding which extends into the operating range of the lever arm serving as a control element wherein the lever arm has at least one bent section compared with the lever arm which acts as a brake wing.

An arrangement can be produced by the inventive construction of the brake device which does not interfere with the characteristics of the ski during downhill skiing, is independent of the design of the ski boot because it is operated exclusively by a ski binding part and for pivoting the lever one spring or for pivoting the two levers a pair of springs is sufficient.

According to a particularly advantageous embodiment of the invention, each projection is constructed as a forked part wherein the one prong is associated with a cam surface on the associated lever and the other prong is associated with the lever arm which serves as a control element and is bent also advantageously corresponding with same.

Through this embodiment, the two movements, which the lever must carry out, are controlled by automatically operative parts. The first prong causes a lifting of the lever; the second prong causes the lever arms which serve as brake wings to be pulled in over the upper surface of the ski. Depending on the need, the lifting action can take place almost up to the ski surface and also the degree of pulling in above the ski surface can be adjusted independent of the elevational position of the lever arms which serve as brake wings.

BRIEF DESCRIPTION OF THE DRAWINGS

Further advantages and details of the invention will be discussed more in detail with reference being made to the drawings which illustrate several exemplary embodiments.

In the drawings:

FIGS. 1 to 4 illustrate a first exemplary embodiment of the inventive brake device wherein FIGS. 1 and 2 illustrate side elevational and top plan views, respectively, of the brake device in the braking position and FIGS. 3 and 4 illustrate side elevational and top plan views, respectively, of the brake device in the ready or unbraked position;

DETAILED DESCRIPTION

Figure 1:
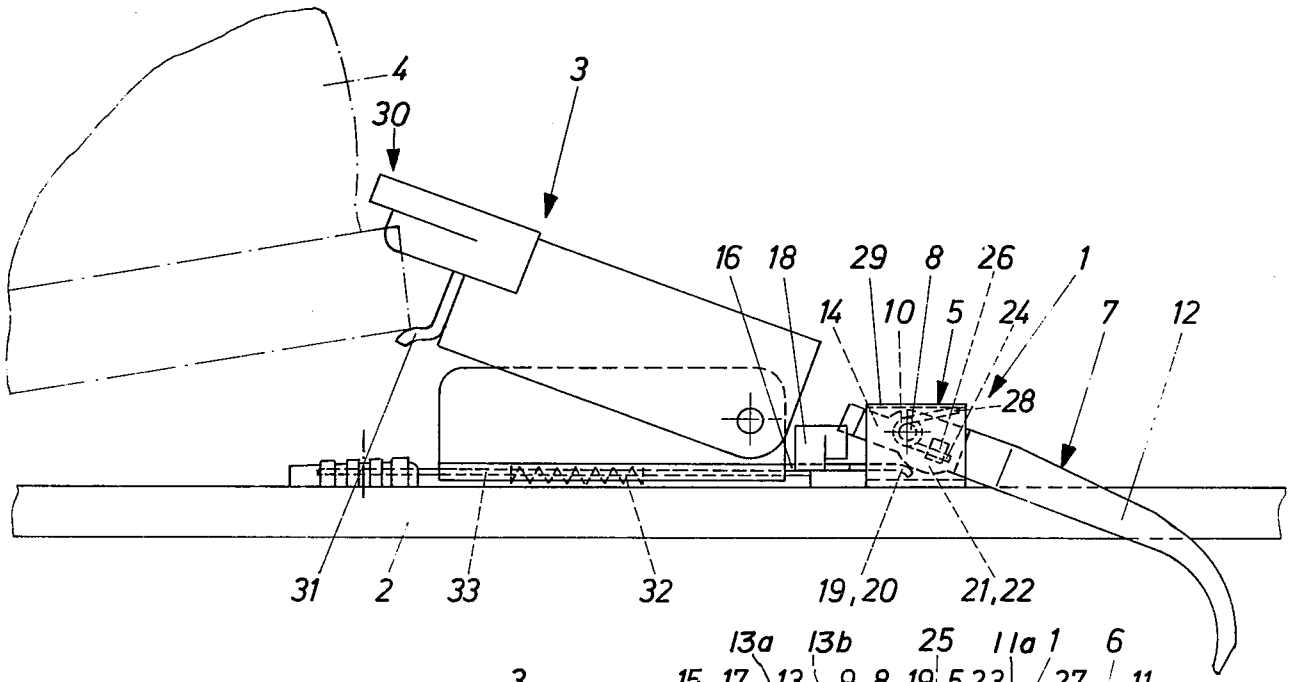
Figure 2:
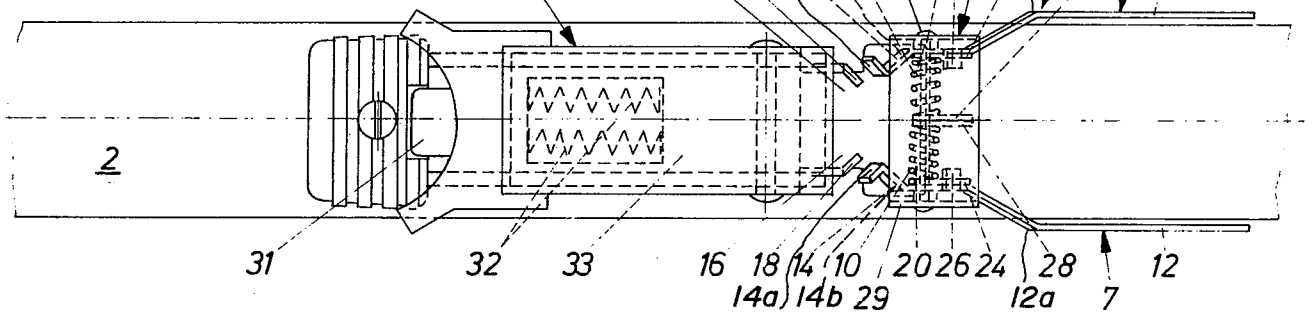
Figure 3:
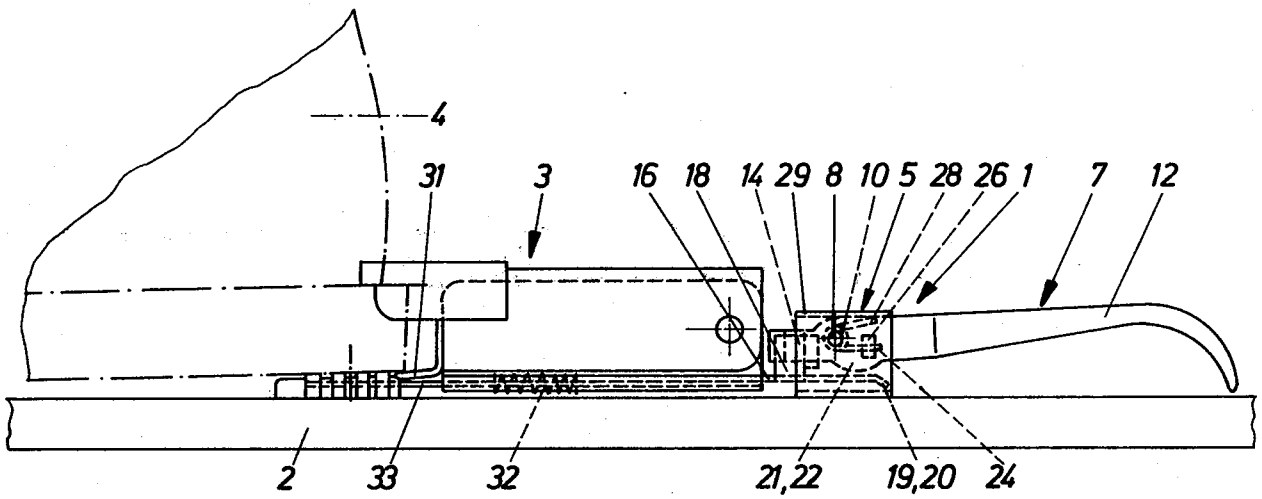
Figure 4:
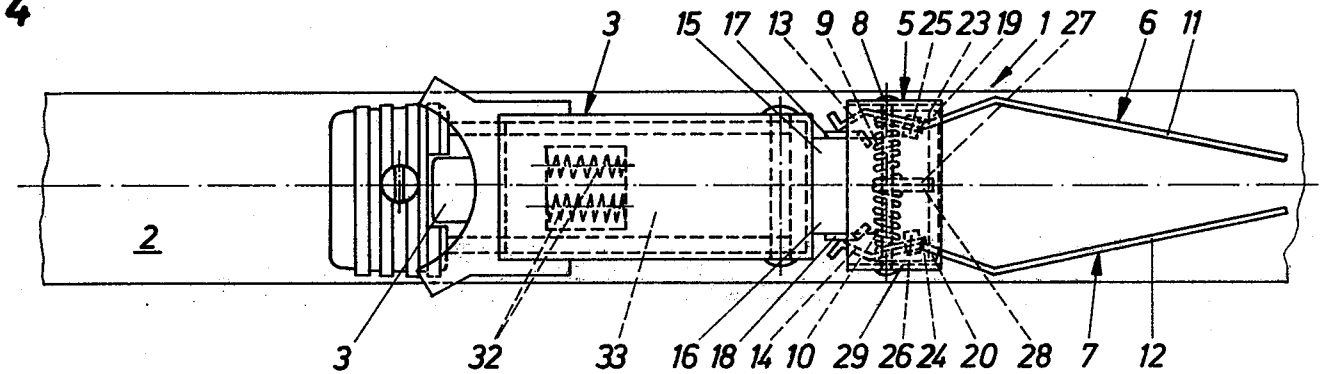

In the exemplary embodiment according to FIGS. 1 to 4, the inventive brake device is a ski brake, which is identified in its entirety with the reference numeral 1, mounted on a ski 2 rearwardly of a ski binding 3 which is designed as an automatically operating heel member. FIGS. 1 and 3 partially indicate the periphery of a ski boot 4 which cooperates with the ski binding 3. The ski boot is omitted in FIGS. 2 and 4.

The ski brake 1 is mounted on the ski 2 by means of a bracket 5. The bracket 5 is secured to the ski 2 in a conventional manner for example by screws, rivets or an adhesive. All of these types of fastenings will be familiar to the man skilled in the art so that further discussion thereof is not needed. The ski brake 1 has two levers 6 and 7 which each have two arms. The two levers 6 and 7 are each pivotally supported for a compound movement about a horizontal pivot axle 8 and a not illustrated vertical pivot axis on the bracket 5 which is positioned transversely with respect to the longitudinal axis of the ski and are each spring loaded for rotary motion by one leg of torsion compression springs 9 and 10. The hole in the levers in which is received the axle 8 is larger than the axle to facilitate the movement about the vertical axis. Both of the levers 6 and 7 each have a long first lever arm portion 11 and 12 which acts as a brake wing and a short second lever arm portion 13 and 14 serving as a control element. The two lever arms 11,12 or 13,14 are offset against one another at approximately 180° in relationship to the pivot axis 8, namely a mirror image of each other. Both pairs of lever arms have bent sections 11*a*, 12*a* and 13*a*, 13*b*; 14*a*, 14*b* respectively of which, however, the first lever arms 11 and 12 serving as brake wings are bent laterally of the ski and the second lever arms 13 and 14, which serve as control elements, are bent twice into an approximate L-shape.

The ski binding 3 has projections, shoulders 15,16 or the like adjacent its rearmost end zone, that is, the end remote from the ski boot 4. Each projection part 15 or 16 has a fork-like construction having prongs 17,18 and 19,20 as illustrated in the drawings. The projection parts 15 and 16 are constructed in one piece in the area which is associated with the ski binding 3. This construction is advantageous for reinforcement reasons. The two levers 6 and 7 each have one cam surface portion 21,22 in their center zone adjacent the pivot axis 8. The cam surface portion 21,22 is operatively engaged by the associated prongs 19 and 20. It can further be recognized from the drawings that the one leg 23,24 of the torsion-compression springs 9,10 is secured to the levers 6 and 7 by means of tabs 25,26 punched out of the reinforced portions 21 and 22, wherein the other leg 27,28 is supported on or rather in the housing 29 of the bracket 5.

OPERATION

The ski brake 1 operates as follows:

Prior to stepping with the ski boot 4 into the ski binding 3, the ski brake assumes the position illustrated in FIGS. 1 and 2. This position corresponds also to the one in which the ski binding is automatically opened during a fall or is voluntarily opened during a stepping out of the ski binding. Whether or not in the last case the ski brake 1 can indeed assume the illustrated position depends on the resistance of the surface on which the stepping out occurs. The lever arms 11 and 12, which are designed as brake wings, can penetrate, of course, only into the material which exists on the surface of the ground if the force of the torsion-compression springs 9 and 10 are sufficiently strong.

For purposes of discussion, it is now assumed that FIGS. 1 and 2 illustrate the position which is created after an automatic release so that the ski brake 1 is in the actual braking position and the skier desires to again enter the ski boot into the ski binding. FIG. 1 illustrates in particular that if a force from the ski boot which acts in the direction of the arrow 30 is applied, the heel of the ski boot 4 will press onto the spur 31 of the ski binding to cause the ski binding 3 to be moved downwardly and backwardly against the force of thrust springs 32 on a holding rail 33 and acting in the longitudinal direction of the ski. A comparison of the two positions according to FIGS. 1 and 2 or 3 and 4 will facilitate a recognition of the differences. More specifically, the thrust springs 32 are formed by two springs in the present example; however, this is unimportant for the subject matter of the invention. During a rearward movement of the ski binding 3, the projections 15 and 16 become active. First the two prongs 19 and 20 on the projections 15 and 16 engage the cam surfaces 21 and 22, respectively, to cause a simultaneous lifting of the two levers 6 and 7 about the horizontal pivot axle 8 due to the cooperating interfit between these parts. After both levers 6 and 7 reach a position which is above the upper ski surface, then the two other prongs 17 and 18 become actively engaged with the second lever arms 13 and 14, particularly the sections 13*a* and 14*a*, respectively, which function as the lateral movement control elements. According to the present exemplary embodiment, the lever arms 13 and 14 are spread further apart about vertical axes wherein the two torsion-compression srings 9 and 10 are additionally compressed together in the axial direction of the pivot axle 8. The ski brake 1 assumes now the position illustrated in FIGS. 3 and 4.

If now the ski binding 3 is opening automatically or voluntarily, the ski binding 3 will be urged forwardly under the action of the thrust springs 32 following the release of the ski boot. First the prongs 17,18 become disengaged from the lever arms 13 and 14 to cause the lever arms 11 and 12 to swing outwardly about the vertical axis until they are positioned outside of the upper ski surface due to the force of the compression portion of the springs 9 and 10. During the further course of forward movement of the ski binding 3, the cooperative structure between the cam surfaces 21 and 22 and the associated prongs 19 and 20 become disengaged after which the ski brake 1 pivots about the horizontal axle 8 and assumes the position illustrated in FIGS. 1 and 2 under the urging of the force of the torsion portion of the springs 9 and 10.

It is easily conceivable to achieve the action which is produced by the projections 15 and 16 on the ski brake 1 by a different construction. For example, it would be possible to provide teeth on the periphery of the cam surfaces 21 and 22 which would cooperate with prongs having teeth thereon. The teeth would have to be adjusted with respect to one another in such a manner that in the position where the levers 6 and 7 have already assumed the ready or cocked position above the upper ski surface, the engagement ceases so that the lateral swing can occur through cooperation of the prongs 17 and 18 with the lever arms 13 and 14 which serve as control elements. However, it is also conceivable to mount a gear or a ratchet wheel in the center area of the levers 6 and 7, which gear or ratchet wheel or gears or ratchet wheels can cooperate with the associated prong 19 or 20. In this case, a bending of the end of the prongs is not needed.

ALTERNATE CONSTRUCTION

Figure 5:
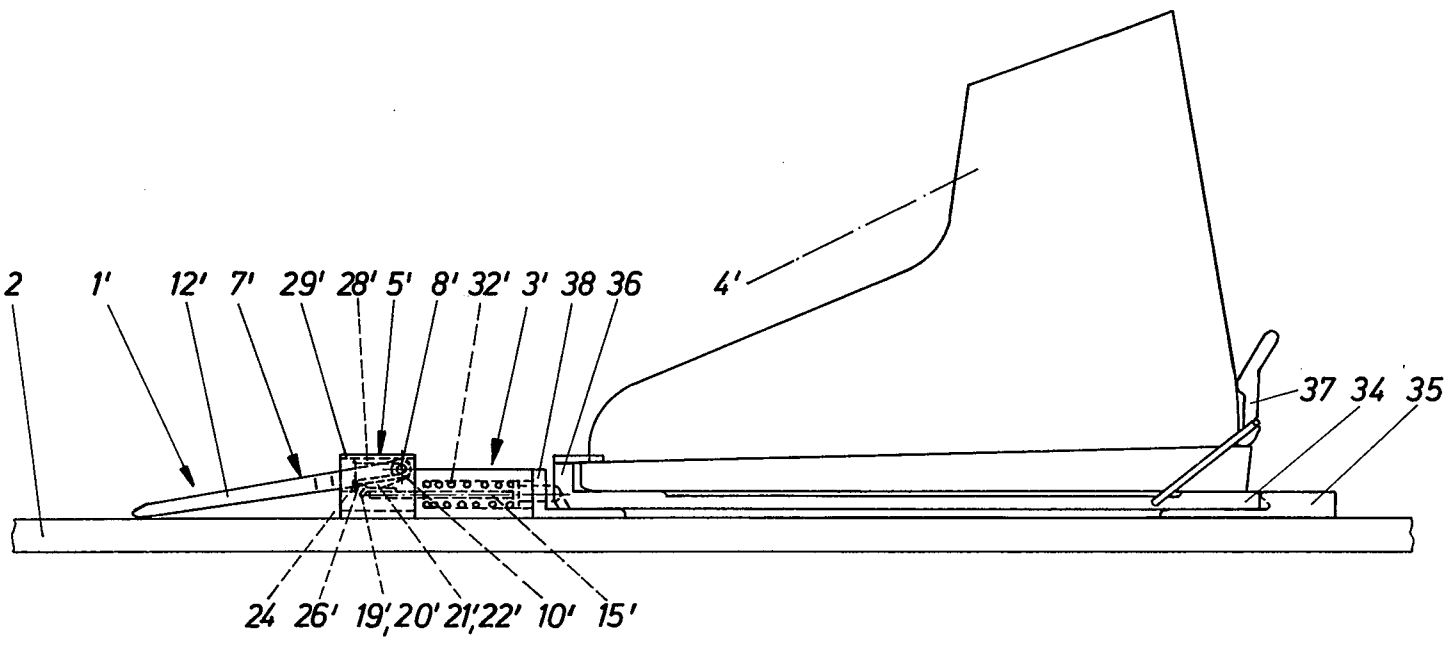
FIG. 5 illustrates a second exemplary embodiment of the inventive brake device cooperating with a front jaw.

The second exemplary embodiment according to FIG. 5 shows that the inventive brake device can be used also in cooperation with a front jaw. Corresponding parts which fulfill the same purposes have thereby been identified with the reference numerals which have already been used in FIGS. 1 to 4, but are differently designated by a prime (') suffix.

The ski brake 1' is here held on the ski by means of a bracket 5', which is combined with a ski binding 3'. A ski boot 4' is held in place by a positioning of a sole plate 34 between a ski binding 3' which serves as a front jaw and a plate mounting 35 adjacent the heel. The ski boot 4' is held on the sole plate 34 by means of front and rear holding devices 36 and 37.

The ski binding 3' has a holding part 38 which is loaded by the thrust springs 32'. The projection 15' extends from the holding part 38 in the direction of the ski brake 1'. The projection 15' is formed in the present example as an elongated push rod. The push rod can be constructed in one piece with the holding part 38, however, it can also be designed as an independent part having a head so that the head serves simultaneously as a support surface for the thrust spring 32'.

Figure 6:
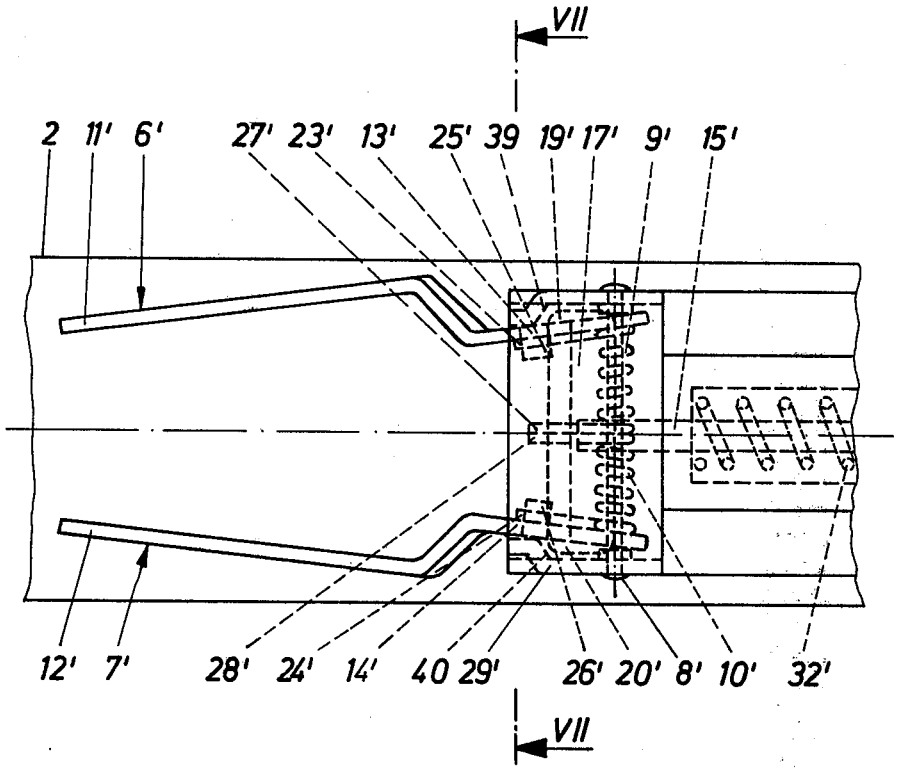
FIG. 6 is a partial top view of the embodiment of FIG. 5.
Figure 7:
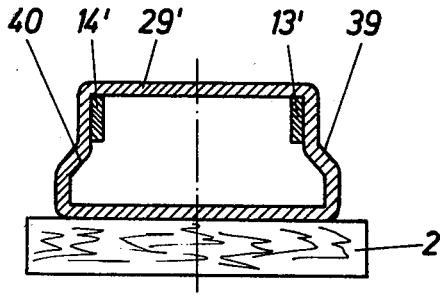
FIG. 7 is a cross-sectional view taken along the line VII—VII of FIG. 6.

As can be recognized particularly well from FIG. 6, a prong 17' which cooperates with the cam surfaces 21', 22' is secured in the front area to the projection 15'. To effect a pulling in of the levers 6' and 7', rising guide surfaces 39 and 40 are provided in the housing 29' of the bracket 5'.

The ski brake 1' is operated substantially in a similar manner as the ski brake 1 according to FIGS. 1 to 4. For this reason, a special illustration of the braking position and the downhill position is not necessary. Only the latter has been shown in the drawings. The holding part 38 with the extension 15' is thereby loaded by the front part of the sole plate 34 and the prong 17' holds the levers 6' and 7' above the upper ski surface. During a lifting of the levers 6' and 7', the levers slide on the rising guide surfaces 39 and 40 of the housing 29' of the bracket 5'. The guide surfaces 39 and 40 cause the levers 6' and 7' to be guided at the same time in a direction toward the ski center so that these are in the end position totally within and above the area of the ski.

This embodiment is also not limited to the illustrated example. For example, it would be possible for a differently designed front jaw to have an associated projection or the like through which the ski brake can be operated. It is also conceivable to provide separate lever arms which act as control elements to pull the free ends of the levers inwardly by cooperating with prongs mounted on the bracket - similarly to the exemplary embodiment according to FIGS. 1 to 4. However, here a spreading apart of the lever arms which serves as the control elements would occur in order to achieve a pulling in adjacent the front area. It is also possible to use the construction of the ski brake, which is shown for use with a front jaw, in cooperation with a heel.

Although a particular preferred embodiment of the invention has been disclosed in detail for illustrative purposes, it will be recognized that variations or modifications of the disclosed apparatus, including the rearrangement of parts lie within the scope of the present invention.

The embodiments of the invention in which an exclusive property or privilege is claimed are defined as follows:

1. A brake device for use on skis having a ski binding component mounted for movement relative to said ski in response to both an engagement with and release from a ski boot, comprising:

at least one lever and pivotal support means pivotally supporting said lever on said ski for movement about a horizontal axis and a vertical axis between a braking position and a retracted position, said lever having two arms, one arm defining a braking wing and the other arm defining a control arm for controlling the movement of said lever about said vertical axis, said lever also having a cam surface thereon;

resilient means continuously urging said lever toward said braking position about both said horizontal and vertical axes whereat said braking wing of said lever extends below the bottom surface of said ski;

first means on said ski binding component movable into engagement with said cam surface in response to an initial engagement of said ski boot therewith to effect a pivoting of said lever about said horizontal axis from said braking position to said retracted position and against the force of said resilient means; and second means on said ski binding component movable into engagement with said control arm in response to a complete engagement of said ski boot therewith to effect a pivoting of said lever about said vertical axis and against the force of said resilient means to position said braking wing entirely over the upper surface of said ski.

2. The brake device according to claim 1, wherein said ski binding component is supported for movement along the longitudinal axis of said ski, and wherein said first means includes a first prong engaging said cam surface to convert the longitudinal movement of said ski binding component into a pivotal movement of said lever about said horizontal axis.

3. The brake device according to claim 2, wherein said cam surface is located along the bottom side of said lever on the brake wing side of said pivotal support means and wherein said first prong effects a lifting of said lever upon engagement with said cam surface.

4. The brake device according to claim 2, wherein said second means includes a second prong engaging said control arm to convert the longitudinal movement of said ski binding component into a pivotal movement of said lever about said vertical axis.

5. The brake device according to claim 4, wherein said second prong includes a first upright surface thereon angled with respect to the longitudinal axis of said ski and wherein said control arm includes a second upright surface generally parallel with said first upright surface and positioned in the path of movement of said first surface so that said first surface, upon engaging said second surface, will effect a pivoting of said lever about said vertical axis.

6. The brake device according to claim 1, wherein said ski binding component includes a pair of connected and relatively movable members, one of which is secured to said ski, the other of which has said first means secured thereto and movable therewith and second resilient means for continuously urging said other member and said first means away from said lever in a direction parallel to the longitudinal axis of said ski.

7. The brake device according to claim 1, wherein said lever is supported for said pivotal movement about said horizontal and vertical axes on a bracket fixedly secured to said ski;

wherein said bracket has a second cam surface thereon inclined in an upward and inward direction relative to the upper surface of said ski; and wherein said control arm is located between said brake wing and said pivotal support means and engages said second cam surface whereby said control arm will slide along said second cam surface in response to said first means engaging said cam surface.

8. The brake device according to claim 1, wherein each arm of said lever is located on opposite sides of said pivotal support means.

9. The brake device according to claim 1, wherein said lever is supported for said pivotal movement about said horizontal and vertical axes on a bracket fixedly secured to said ski; and wherein said pivotal support means includes an axle and means defining a hole in said lever, the size of said hole being larger than the size of said axle to facilitate the movement of said lever about said vertical axis.

10. The brake device according to claim 1, wherein said resilient means includes a combined torsion and compression spring encircling said axle, a pivotal movement of said lever about said horizontal axis being against the torsional force of said spring and a pivotal movement of said lever about said vertical axis being against the compression force of said spring.

11. The brake device according to claim 1, including an additional lever which is a mirror image of said first-mentioned lever and wherein said pivotal support means pivotally supports said additional lever for movement about a horizontal axis and a vertical axis between a braking position and a retracted position.

* * * * *

UNITED STATES PATENT AND TRADEMARK OFFICE

CERTIFICATE OF CORRECTION

PATENT NO. : 4 116 461

DATED : September 26, 1978

INVENTOR(S) : Erwin Krob and Josef Svoboda

It is certified that error appears in the above–identified patent and that said Letters Patent are hereby corrected as shown below:

Column 7, line 8; change "1" to ---9---.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*